United States Patent [19]

Van Klompenburg et al.

[11] 4,241,541

[45] Dec. 30, 1980

[54] DUAL ARM OPERATOR FOR A CASEMENT-TYPE WINDOW

[75] Inventors: Marlo G. Van Klompenburg, Sioux Center, Iowa; Jeffery A. Peterson, Canby; Eric W. Nelson, Minneapolis, both of Minn.

[73] Assignee: Truth Incorporated, Owatonna, Minn.

[21] Appl. No.: 46,800

[22] Filed: Jun. 8, 1979

[51] Int. Cl.[3] ..... E05F 11/24

[52] U.S. Cl. ..... 49/249; 49/342

[58] Field of Search ..... 49/246, 248–253, 49/260, 261, 341–343, 345, 346, 324

[56] References Cited

U.S. PATENT DOCUMENTS

| | | | |
|---|---|---|---|
| 2,674,452 | 4/1954 | Hummert | 49/251 X |
| 3,032,330 | 5/1962 | Stavenau | 49/249 |
| 3,085,299 | 4/1963 | Reynaud | 49/394 X |
| 3,438,151 | 4/1969 | Evers et al. | 49/345 |
| 3,838,537 | 10/1974 | Stavenau et al. | 49/251 X |

*Primary Examiner*—Philip C. Kannan

*Attorney, Agent, or Firm*—Wegner, Stellman, McCord, Wiles & Wood

[57] ABSTRACT

An operator for a casement-type window having an openable sash mounted adjacent one edge thereof for combined pivoting and linear movement of said sash edge relative to a window frame. The operator includes a first operator arm rotatable about a fixed axis and having an end adapted for movable engagement with the sash at a distance from said one edge of the sash to impart a rotational force to the sash, a second operator arm and a connecting link pivotally connected between said second operator arm and the sash adjacent said edge, and said second operator arm being pivotally mounted on the first operator arm, with there being intermeshing drive gears fixed one to each of said arms, with one gear being a drive gear and the other gear being a driven gear. Rotation imparted to the drive gear causes rotation of the first operator arm and bodily movement and rotation of the second operator arm with the latter arm exerting a force on the connecting link acting in a direction generally parallel to the path of linear movement of the sash edge.

10 Claims, 4 Drawing Figures

DUAL ARM OPERATOR FOR A CASEMENT-TYPE WINDOW

BACKGROUND OF THE INVENTION

This invention pertains to an operator for a casement-type window utilizing a pair of operator arms, both of which are rotatably mounted and with one arm engageable with the sash at a distance from the mounting edge of the sash to impart a rotational force thereto and the other operator arm connected to the sash adjacent the mounting edge thereof through a connecting link to exert a force acting in a direction generally parallel to the path of linear movement of the sash edge whereby the two arms work together and either the rotational force-applying arm or the linear force-applying arm may be effective, dependent upon which arm instantaneously encounters the least resistance in opening or closing of the sash.

A window of the general type to which the invention disclosed herein relates is shown in Gill U.S. Pat. No. 2,948,027. In such a window, the sash is mounted adjacent one edge at the top and bottom on slider structure including a slider movable in a guide track whereby said edge of the sash has both combined linear and pivotal movements along with pivotal movement of the sash. A constraining link is connected between the sash and window frame for guiding the sash movement.

Many different structures are known for a casement-type window operator wherein a manually operated pivotal operating arm is either directly or indirectly connected to the window sash for causing opening and closing movement thereof. The sash-mounting structure including the slider structure and the constraining link prescribe a certain timing between the velocity of the slider moving along a straight line path and the angular velocity of the sash which is hard to match with the conventional pivotal operating arm. Examples of conventional operator structures using a manually operated pivotal operating arm are shown in Reynaud U.S. Pat. No. 3,085,299 and Evers et al. U.S. Pat. No. 3,438,151.

SUMMARY OF THE INVENTION

A primary feature of the invention disclosed herein is to provide an operator having a pair of operating arms for causing opening and closing movement of the sash of a casement-type window, with one arm being connectable to the sash at a distance from the edge thereof which is connected to the slider for imparting rotational movement to the sash and the other arm being connectable through a connecting link to said edge of the sash whereby the operator arms are free to follow the sash movement determined by the mounting structure therefor and with the arms following the path of least resistance whereby whichever arm can move the easiest will move to cause appropriate movement of the sash.

Additional features of the invention are to provide a dual arm window operator which: provides easy, smooth operation in opening and closing of the window; minimizes the loading on the gearing utilized in the operator; provides for a balance of forces between the operator arms; and maximizes the application of forces resulting from wind loads to the constraining link connected between the sash and the window frame.

An object of the invention is to provide an operator for a casement-type window having a pair of operators for the sash which has one edge confined to straight line movement with one arm applying rotational force to the sash and the other arm applying a force to said edge of the sash in a direction generally parallel to said straight line movement.

Another object of the invention is to provide an operator as defined in the preceding paragraph wherein a first operator arm is pivotal about a fixed axis and movably engages the sash at a distance from said edge of the sash and the second arm is pivotally mounted on the first arm for bodily movement as the first operator arm is rotated and with gear means responsive to a manual input for rotating the first operator arm and causing rotation of the second operator arm as it moves bodily with said first operator arm.

Still another object of the invention is to provide an operator for a casement-type window having an openable sash mounted adjacent one edge thereof for combined pivoting and linear movement of said sash edge relative to a window frame comprising a casing mountable on said frame, a first relatively long operator arm extending from said casing and rotatable about a fixed axis in said casing and having an end remote from said casing movably engageable with the sash at a distance from said one edge to impart a rotational force to said sash, a second relatively short operator arm rotatably mounted on said first operator arm and extending from said casing, a connecting link pivotally connected between an end of said second operator arm and a bracket mountable to said sash adjacent said edge, means for rotating said first operator arm, and means for rotating said second operator arm as it moves bodily with the first operator arm to exert a force on the connecting link acting in a direction generally parallel to the path of linear movement of said sash edge.

DESCRIPTION OF THE PREFERRED EMBODIMENT

Figure 1:
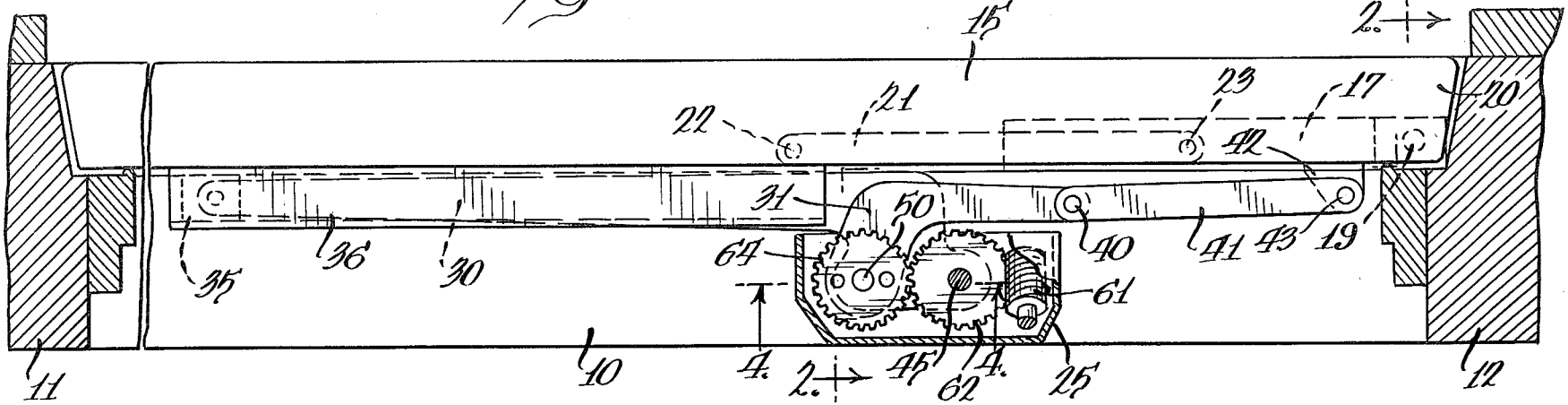
FIG. 1 is a fragmentary plan section of a casement-type window in closed position showing the operator associated therewith, with parts broken away.

A casement-type window is shown generally in the drawings wherein a sill 10 has a pair of side jambs 11 and 12 at opposite ends thereof and extending upwardly therefrom. A window sash 15 is mounted within the frame for movement between the closed position, shown in FIG. 1, and the fully-open position, shown in FIG. 3. The sash is mounted for opening and closing movement which consists of both pivoting and linear movement thereof by slider structure mounted at both the top and bottom thereof adjacent one edge of the sash.

Figure 2:
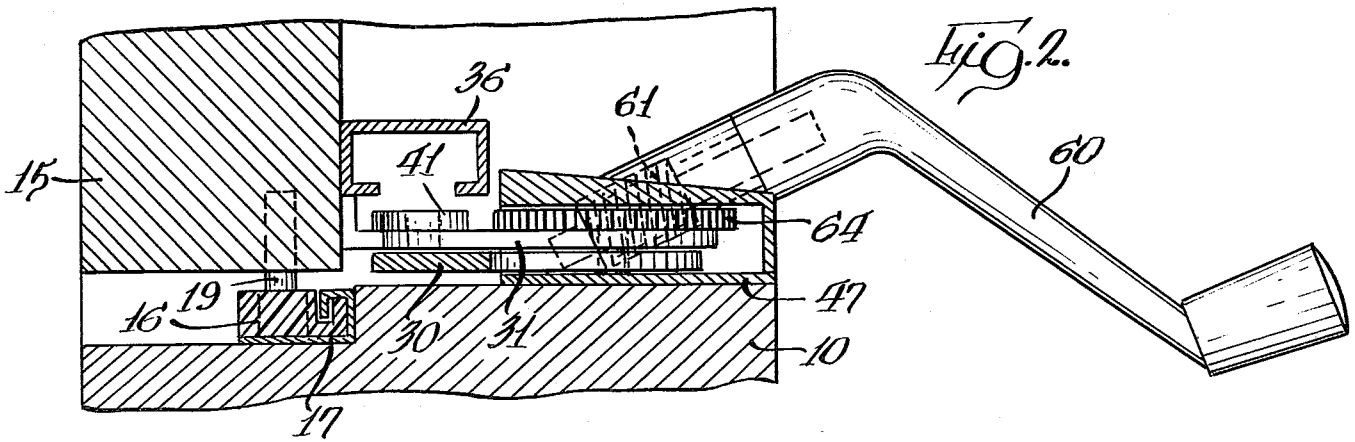
FIG. 2 is a vertical section, taken generally along the line 2—2 in FIG. 1.
Figures 3, 4:
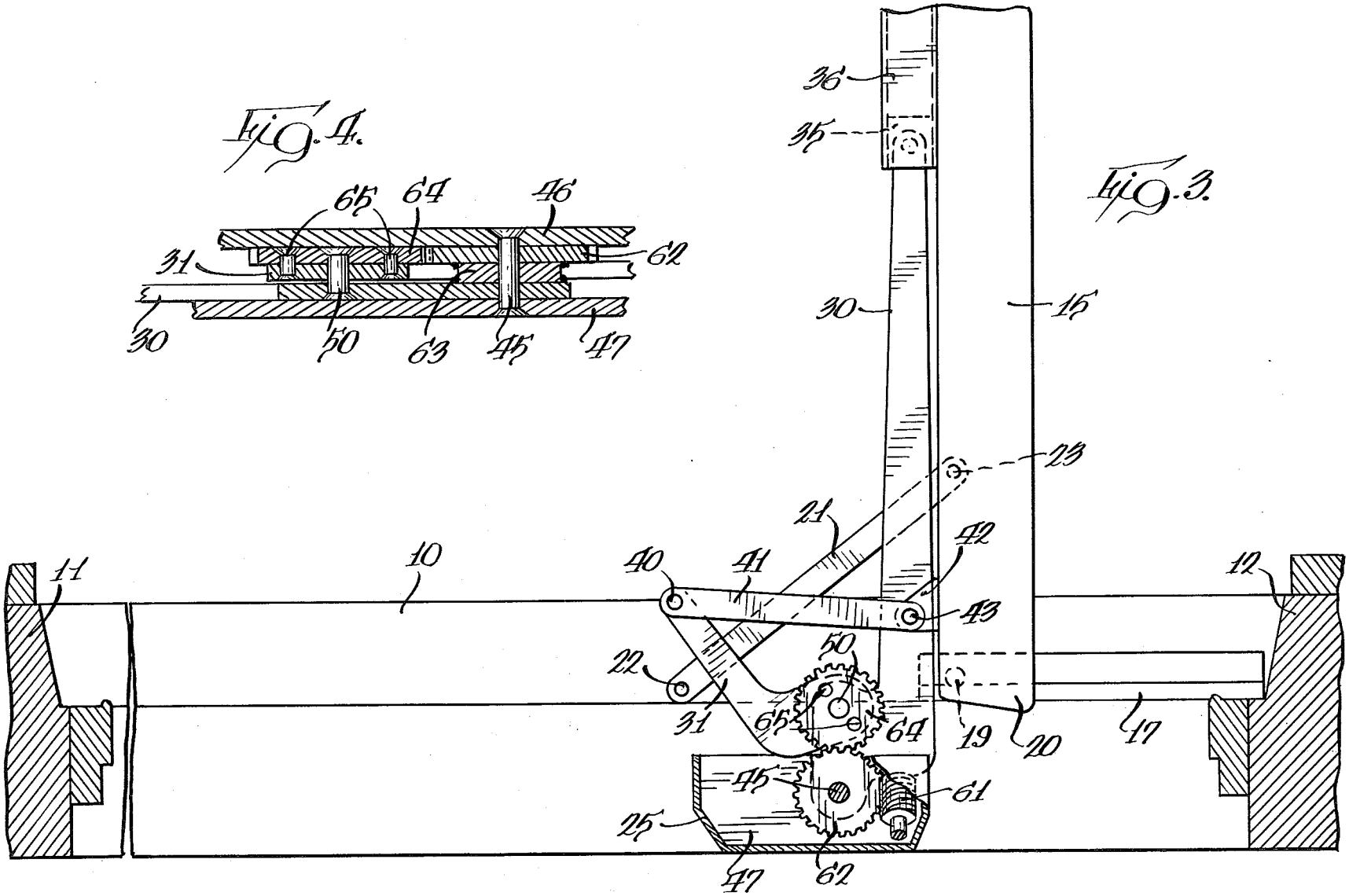
FIG. 3 is a view, similar to FIG. 1, showing the window in fully-open position.
FIG. 4 is a vertical section, taken generally along the line 4—4 in FIG. 1.

As shown in FIG. 2, the slider structure has a slider 16 movable within a track 17 fitted to the window sill 10 and the slider pivotally supports the sash by connection thereto through a pivot pin 19. The slider 16 guides an edge 20 of the sash 15 for linear movement along a straight line path, as defined by the track 17. Additionally, it is typical to have a constraining link 21 which extends between the window sill and the sash. As best shown in FIG. 3, the constraining link 21 is pivotally connected at 22 to the window sill and at 23 to the window sash. This structure is present at both top and bottom of the sash and is of a type generally shown and described in the aforesaid Gill patent and reference may be made thereto for a more detailed description of the slider structure and the constraining link. With the structure described, the window sash 15 is guided in its movement from the closed position, shown in FIG. 1, to the fully-open position, shown in FIG. 3, with the movement being a combination of pivoting and linear movement and with there being a timing relation between the velocity of the slider 16 and the angular velocity of the sash.

The operator for the window includes a casing 25 which is attachable to the window sill 10 and which has structure for movably mounting dual operator arms including a relatively long first operator arm 30 and a relatively short second operator arm 31. The first operator arm 30 movably engages the sash 15 at a distance from the edge 20 thereof by having a movable member 35 at an end thereof which can move along a guide channel 36 fixed to the inner face of the lower rail of the sash.

The second operator arm 31 is pivotally connected at 40 at an end thereof to a connecting link 41 which extends between the second operator arm and a bracket 42 which is pivotally connected to the connecting link at 43 and which is connectable to the lower rail of the sash adjacent the edge 20 thereof.

The first operator arm 30 is rotatable about a fixed axis within the casing 25 and, more particularly, about a pin 45 extended between upper and lower walls 46 and 47, respectively, of the casing 25. Rotation of the first operator arm about the fixed axis defined by the pin 45 moves the member 35 at the outer end thereof through an arc whereby a force is applied to the window sash at a distance from the edge 20 thereof tending to impart rotational force to the sash with resulting opening or closing movement thereof.

The second operator arm 31 is mounted on the first operator arm 30 for bodily movement therewith by means of a pin 50 fixed to and extending upwardly from the first operator arm 30 and which rotatably extends through the second operator arm 31.

Rotation of the first operator arm 30 is derived from manual force applied through a crank 60 (FIG. 2) which rotates a worm 61 which extends at an angle to the axis of the pivot pin 45 and meshes with a drive gear 62 rotatably mounted on the pivot pin 45 and fixed to the first operator arm 30 through a connecting member 63 secured to both parts by suitable means, such as welding. The drive gear 62 meshes with a driven gear 64 positioned above and fixed to the second operator arm 31 by pins 65 whereby as the latter arm is caused to move bodily the arm also rotates because of the mesh between the gears 62 and 64, with the result that a force is applied to the sash adjacent the edge 20 through the connecting link 41 which acts in a direction generally parallel to the straight line movement of the sash edge.

With the window shown closed in FIG. 1, rotation of the crank 60 causes rotation of the worm 61 to rotate the gear 62 and cause clockwise rotation of the first operator arm 30 about the fixed axis defined by pin 45 to impart a force to the window sash tending to move the sash toward open position with the ultimate open position being shown in FIG. 3. The rotation of the first operator arm causes movement of the pin 50 in an arc about the fixed axis defined by the pin 45 whereby the second operator arm 31 is moved bodily from the position shown in FIG. 1 to a position shown in FIG. 3 for full opening movement of the window. During this movement, the second operator arm 31 also has counterclockwise movement about the axis of pin 50 between the position shown in FIG. 1 wherein the arm is in generally straight line relation with the connecting link 41 and intermediate positions to the position shown in FIG. 3 wherein the operator arm and the connecting link 41 are at an acute angle. With the window fully open, as shown in FIG. 3, a rotation of the crank 60 in the opposite direction causes a reversal of motions with sufficient rotation of the crank being effective to bring the sash back to a closed position shown in FIG. 1.

The window sash 15 is constrained to a certain path of movement by the slider structure 16 and the constraining link 21. With the distinct application of forces by the two operator arms, either one of the arms may predominate at any time to primarily exert rotational force or, alternatively, exert linear force through the connecting link 41 to cause sash movement depending upon whichever force encounters the least resistance at a particular moment, dependent upon the constrained path of movement of the sash provided by the mounting structure therefor.

In designing the dual arm window operator, dimensional relations were achieved between the pivot points for the arms and the dimensioning thereof to have each arm contribute approximately the same moment about the pivot point defined by the pivot pin 45 with the result that optimization is achieved in terms of opening and closing ease of operation and reaction to forces created by wind loading. Additionally, the maximum force experienced by the teeth of the gears 62 and 64 per pound of wind load is minimized, with the result that gear loading of the teeth is less than 25% of that developed in the current commercial operator manufactured by the assignee of this application.

Additionally, the structure of the operator has resulted in the ability to have the constraining link 21 react to a greater force from wind loading than encountered in said current commercial operator, with the result that more of the potentially damaging forces from the action of wind acting on an open window sash are directed to the link 21 with its two-point connection to the sash and window frame, rather than to the window operator with its intermeshing gears.

Although the operator is disclosed for use in a casement-type window which is guided for movement by slider structure and a constraining link, it will be obvious that the operator will operate satisfactorily with omission of the constraining link 21.

The embodiment disclosed has a rotatable crank 60 for rotating a worm to impart motion to the drive gear 62. Alternative to the use of the rotatable crank 60, it is known to utilize a lever actuator for a window operator which normally has an arc of movement of 180°. If it is desired to use such lever, it can be pinned to the pivot pin 45 with the latter pivot pin being mounted for rotation and secured to the gear 62 whereby rotation of the lever through its arc will rotate the pivot pin 45 to cause the same action of the window operator as previously described.

We claim:

1. An operator for a casement-type window having an openable sash mounted adjacent one edge thereof for combined pivoting and linear movement of said sash edge relative to a window frame comprising, a first operator arm rotatable about a fixed axis and having an end adapted for movable engagement with the sash at a distance from said one edge to impart a rotational force to said sash, a second operator arm, a connecting link pivotally connected to said second operator arm and pivotally connectable to said sash adjacent said edge, and means responsive to rotation of the first operator arm for rotating and bodily moving said second operator arm to exert a force on the connecting link acting in a direction generally parallel to the path of linear movement of said sash edge.

2. An operator as defined in claim 1 wherein said means for rotating and bodily moving said second operator arm comprises, rotatably mounting the second operator arm on said first operator arm, and a pair of meshing gears including a drive gear rotatable about said fixed axis and fixed to said first operator arm for rotation therewith and a driven gear fixed to said second operator arm and rotatable coaxially therewith.

3. An operator for a casement-type window having an openable sash mounted adjacent one edge thereof for combined pivoting and linear movement of said sash edge relative to a window frame comprising, a first rotatable operator arm having an end for engagement with the sash, a second rotatable operator arm, a connecting link pivotally connected to said second operator arm and pivotally connectable to said sash, means responsive to rotation of one of the operator arms for rotating and bodily moving the other operator arm and means for causing rotation of said one operator arm.

4. An operator for a casement-type window having an openable sash mounted adjacent one edge thereof a slider structure for combined pivoting and linear movement of said sash edge relative to a window frame and with the movement controlled by a constraining link pivotally connected between the sash and frame comprising, a first operator arm rotatable about a fixed axis and having an end movably engageable with the sash at a distance from said one edge to impart a rotational force to said sash, a second operator arm, a connecting link pivotally connected to said second operator arm and connectable to said sash adjacent said edge, means responsive to rotation of the first operator arm for rotating and bodily moving said second operator arm to exert a force on the connecting link acting in a direction generally parallel to the path of linear movement of said sash edge, and means for rotating said first operator arm.

5. An operator as defined in claim 4 wherein said means for rotating and bodily moving said second operator arm comprises, rotatably mounting the second operator arm on said first operator arm, and meshing gears fixed one to each of said operating arms.

6. An operator for a casement-type window having an openable sash mounted adjacent one edge thereof for combined pivoting and linear movement of said sash edge relative to a window frame comprising, a casing mountable on said frame, a first relatively long operator arm extending from said casing and rotatable about a fixed axis in said casing and having an end remote from said casing movably engageable with the sash at a distance from said one edge to impart a rotational force to said sash, a second relatively short operator arm rotatably mounted on said first operator arm and extending from said casing, a connecting link pivotally connected between an end of said second operator arm and a bracket mountable to said sash adjacent said edge, means for rotating said first operator arm, and means for rotating said second operator arm as it moves bodily with the first operator arm to exert a force on the connecting link acting in a direction generally parallel to the path of linear movement of said sash edge.

7. An operator as defined in claim 6 wherein said means for rotating the second operator arm comprises, a drive gear rotatable about said fixed axis and fixed to said first operator arm and a driven gear fixed to said second operator arm and rotatable coaxially therewith and meshing with said drive gear.

8. An operator as defined in claim 7 wherein the sash edge is mounted by a linearly movable slider and sash movement is controlled by a constraining link pivotally connected between the sash and frame, and the length of said operator arms and the location of their pivots are selected whereby gear loading of said gears is minimized and the operator arms apply forces in a direction consistent with the path of sash movement as determined by said constraining link and slider.

9. For a casement-type window having an openable sash mounted adjacent one edge by a linearly movable slider for combined pivoting and straight-line linear movement of said sash edge relative to a window frame, an operator comprising, a casing, a first relatively long operator arm rotatable about a fixed axis in said casing and having an end movably engageable with the sash at a distance from said one edge to impart a rotational force to said sash, a second relatively short operator arm, a connecting link pivotally connected between said second operator arm and a bracket connectable to said sash adjacent said edge, and means responsive to rotation of the first operator arm for rotating said second operator arm to exert a force on the connecting link acting in a direction generally parallel to the straight-line linear movement of said sash edge.

10. An operator as defined in claim 3 wherein said first rotatable operator arm has the end movably engageable with the sash at a distance from said sash edge to impart a rotational force to the sash, said pivotal connection of the connecting link to the sash being adjacent to said sash edge whereby movement of the connecting link imparts a force to the sash adjacent said sash edge which acts in a direction generally parallel to the path of movement of the sash edge, and said other operator arm being rotatably mounted on said one operator arm.

* * * * *